US008217247B2

(12) United States Patent
Horsley

(10) Patent No.: US 8,217,247 B2
(45) Date of Patent: Jul. 10, 2012

(54) ADJUSTABLE CHROMATIC CHORD HARMONICA

(76) Inventor: Douglas Peter Horsley, Calgary (CA)

( * ) Notice: Subject to any disclaimer, the term of this patent is extended or adjusted under 35 U.S.C. 154(b) by 0 days.

(21) Appl. No.: 12/728,246

(22) Filed: Mar. 21, 2010

(65) Prior Publication Data

US 2010/0236378 A1 Sep. 23, 2010

(51) Int. Cl.
*G10D 7/12* (2006.01)

(52) U.S. Cl. ..... 84/377

(58) Field of Classification Search ..... 84/377, 84/378

See application file for complete search history.

(56) References Cited

U.S. PATENT DOCUMENTS 2,228,058 A * 1/1941 Lederfine ..... 84/378
2,655,068 A * 10/1953 Ruben ..... 84/377
3,580,125 A * 5/1971 Heatwole ..... 84/377
3,674,910 A * 7/1972 McKenzie ..... 84/377
3,757,025 A * 9/1973 Huang ..... 84/377
3,986,427 A * 10/1976 Swain ..... 84/377
7,122,729 B2 * 10/2006 Lin ..... 84/377

* cited by examiner

*Primary Examiner* — Jianchun Qin

(57) ABSTRACT

An adjustable chromatic harmonica incorporating an adjustable mouthpiece where, for each mouth-hole, the player's breath may be selectively connected to one or more available reed cells. This is by means of a rotatable cup-shaped valve, with an opening or port in its side, being mounted in each mouth-hole such that the port can be registered by rotation with one of a group of surrounding air ducts, each of which is connected to one or more reed cells in the body of the harmonica. In some embodiments an apertured slide is interposed between the mouthpiece and the body. In some embodiments devices are provided for rotating the valves in independent groups while the harmonica is being played. In embodiments where each group of mouth-holes can be independently adjusted, a large number of physical states is possible. Consequently, some embodiments have the capability of playing chromatic melodies and several common chord types in all twelve musical keys.

6 Claims, 10 Drawing Sheets

Fig. 16.

| | |
|---|---|
| G#-C-D# | G# |
| G-C-E | C |
| G#-B-E | E |
| A-C#-E | A |
| G#-C#-F | C# |
| A-C-F | F |
| G#-B-D# | G#m |
| G-C-D# | Cm |
| G-B-E | Em |
| A-C-E | Am |
| G#-C#-E | C#m |
| G#-C-F | Fm |
| G-B-D# | Gaug |
| G#-C-E | G#aug |
| A-C#-F | Aaug |
| G-C-F | Gsus |
| A-B-E | Bsus |
| G#-C#-D# | D#sus |
| A-C-D# | Adim |
| G-C#-E | C#dim |
| G#-B-F | Fdim |
| G-B-F | G7 |
| A-B-D# | B7 |
| G-C#-D# | D#7 |
| A-C#-D# | A(b5) |
| G-C#-F | C#(b5) |
| A-B-F | F(b5) |

Fig. 17.

| | |
|---|---|
| A#-D-F | A# |
| A-D-F# | D |
| A#-C#-F# | F# |
| B-D#-F# | B |
| A#-D#-G | D# |
| B-D-G | G |
| A#-C#-F | A#m |
| A-D-F | Dm |
| A-C#-F# | F#m |
| B-D-F# | Bm |
| A#-D#-F# | D#m |
| A#-D-G | Gm |
| A-C#-F | Aaug |
| A#-D-F# | A#aug |
| B-D#-G | Baug |
| A-D-G | Asus |
| B-C#-F# | C#sus |
| A#-D#-F | Fsus |
| B-D-F | Bdim |
| A-D#-F# | D#dim |
| A#-C#-G | Gdim |
| A-C#-G | A7 |
| B-C#-F | C#7 |
| A-D#-F | F7 |
| B-D#-F | B(b5) |
| A-D#-G | D#(b5) |
| B-C#-G | G(b5) |

Fig. 18.

| | |
|---|---|
| A-C#-E | A |
| G#-C#-F | C# |
| A-C-F | F |
| A#-D-F | A# |
| A-D-F# | D |
| A#-C#-F# | F# |
| A-C-E | Am |
| G#-C#-E | C#m |
| G#-C-F | Fm |
| A#-C#-F | A#m |
| A-D-F | Dm |
| A-C#-F# | F#m |
| G#-C-E | G#aug |
| A-C#-F | Aaug |
| A#-D-F# | A#aug |
| G#-C#-F# | G#sus |
| A#-C-F | Csus |
| A-D-E | Esus |
| A#-C#-E | A#dim |
| G#-D-F | Ddim |
| A-C-F# | F#dim |
| G#-C-F# | G#7 |
| A#-C-E | C7 |
| G#-D-E | E7 |
| A#-D-E | A#(b5) |
| G#-D-F# | D(b5) |
| A#-C-F# | F#(b5) |

Fig. 19.

| | |
|---|---|
| B-D#-F# | B |
| A#-D#-G | D# |
| B-D-G | G |
| C-E-G | C |
| B-E-G# | E |
| C-D#-G# | G# |
| B-D-F# | Bm |
| A#-D#-F# | D#m |
| A#-D-G | Gm |
| C-D#-G | Cm |
| B-E-G | Em |
| B-D#-G# | G#m |
| A#-D-F# | A#aug |
| B-D#-G | Baug |
| C-E-G# | Caug |
| A#-D#-G# | A#sus |
| C-D-G | Dsus |
| B-E-F# | F#sus |
| C-D#-F# | Cdim |
| A#-E-G | Edim |
| B-D-G# | G#dim |
| A#-D-G# | A#7 |
| C-D-F# | D7 |
| A#-E-F# | F#7 |
| C-E-F# | C(b5) |
| A#-E-G# | E(b5) |
| C-D-G# | G#(b5) |

ADJUSTABLE CHROMATIC CHORD HARMONICA

CROSS-REFERENCE TO RELATED APPLICATIONS

This application claims the benefit of Canadian Patent Application No. 2,659,016, filed 2009 Mar. 23 by the present inventor.

BACKGROUND

1. Field

The present invention relates to chromatic harmonicas and other harmonicas having an adjustable mouthpiece.

2. Tabulation of Prior Art

The following is a tabulation of some prior art that presently appears relevant:

| Patent No. | Country | Publication Date | Applicant or Patentee |
|---|---|---|---|
| 2,005,443 | US | Jun. 18, 1935 | Steele |
| 1,004,024 | DE | Sep. 24, 1954 | Kaiser |
| 5,915,287 | US | Jun. 22, 1999 | Fox |
| 3,674,910 | US | Jul. 4, 1972 | McKenzie |
| 3,149,527 | US | Sep. 22, 1964 | Kraft |
| 1,255,465 | DE | Nov. 30, 1967 | Huang |
| 2,646,712 | US | Jul. 28, 1953 | Mast |
| 2,827,818 | US | Mar. 25, 1958 | Bibus |
| 2,478,963 | US | Aug. 16, 1949 | Bibus |
| 2,496,511 | US | Feb. 7, 1950 | Abbot |
| 1,194,090 | FR | Mar. 31, 1958 | Harmonika Narodi Podnik |
| 3,986,427 | US | Oct. 16, 1976 | Swain |
| 2,655,068 | US | Oct. 13, 1953 | Ruben |
| 2,256,682 | US | Sep. 23, 1941 | Machino |
| 2,567,888 | US | Sep. 11, 1951 | Meyers |
| 1,714,663 | US | May 28, 1929 | Fahrini |
| 1,231,802 | UK | Feb. 22, 1967 | Wood |
| 2,755,696 | US | Jul. 24, 1956 | Legler |
| 841,257 | DE | Jun. 13, 1952 | Lochel |

3. Discussion of Prior Art

A conventional chromatic harmonica is adjustable between two states. This is achieved by incorporating into the mouthpiece a movable metal slide that, as it alternates between left and right positions, selects between two sets of reed cells. The effect is that of switching between two diatonic harmonicas, the second typically tuned a semitone higher than the first, thereby allowing the playing of accidental (sharp and flat) notes, and thus the playing of melodies in all musical keys. This harmonica has a very limited number of chords.

Other adjustable harmonicas have been designed that allow switching between three sets of reed cells yielding three states, (U.S. Pat. No. 5,915,287) and (DE 1,004,024), and switching between four sets of reed cells yielding four states, (U.S. Pat. No. 3,674,910) and (U.S. Pat. No. 3,149,527). However, even with three or four states the number and variety of chords achieved has been very limited.

A design of special interest was commercially available as the "Hohner Chordomonica" (DE 1,255,465). This design provides four states with only two sets of reed cells. This is achieved by having two slides operating independently, where each slide affects one of two different groups of mouth-holes. As manufactured, the four states of this harmonica provided a few chords in the specific key of the harmonica, but did not facilitate playing of chromatic melodies.

Another design of special interest was commercially available as the "Hohner Harmonetta", apparently utilizing ideas from both (U.S. Pat. No. 2,827,818) and (U.S. Pat. No. 2,646,712). This design presented the player with a double array of closely spaced mouth-holes which were inactive unless the associated reed cell was unblocked by a mechanical linkage. This instrument allowed a completely free choice of notes, but was bulky and could not easily be played as one would play a harmonica. It was also difficult to maintain in playing condition owing to its mechanical complexity.

There have been many other designs for harmonicas and related instruments that have provided a large number of states, but they generally have one or more of the following limitations: inconveniently large or awkward; complex to manufacture; frequent maintenance required; physically difficult to play; requiring new skills to play; or emphasizing access to chords to the detriment of ease of melodic playing.

A review of previous designs shows that it has been a longstanding and desirable goal to have an adjustable harmonica that is easy to manufacture and maintain, and is capable of a large number of states, thereby allowing the playing of chromatic melodies combined with a large number of chords, and is of a design that can be applied to harmonicas that are compact and playable using established skills and techniques.

SUMMARY

This discussion presents an adjustable harmonica which has an adjustable mouthpiece where, for each mouth-hole, the player's breath can be selectively connected to one of several reed cells available to that mouth-hole. This is by means of a rotatable cup-shaped valve, with an opening or port in its side, being mounted in each mouth-hole. The port can, by rotation of the valve, be registered with one of a group of surrounding air ducts, each of which is connected to one or more reed cells in the body of the harmonica. In embodiments where individual valves, or groups of valves, can rotate independently of each other, a large number of states is possible.

Various embodiments, constructed accordingly, have some or all of the following advantages. An adjustable harmonica that is easy to manufacture and maintain, that has a large number of states which may be utilized to provide an instrument that is fully chromatic in melody and chords, and that is compact and playable in a fashion similar to that of existing chromatic harmonicas.

These and other advantages of one or more embodiments will become apparent from a consideration of the drawings and the ensuing description.

LIST OF DRAWINGS

FIG. 16 is table of the 27 combinations of blow notes available with the slide leftward, followed by a chord symbol for each combination.

FIG. 17 is table of the 27 combinations of draw notes available with the slide leftward, followed by the chord symbol for each combination.

FIG. 18 is table of the 27 combinations of blow notes available with the slide rightward, followed by the chord symbol for each combination.

FIG. 19 is table of the 27 combinations of draw notes available with the slide rightward, followed by the chord symbol for each combination.

DETAILED DESCRIPTION OF A PRACTICAL EMBODIMENT

Figures 1, 2:
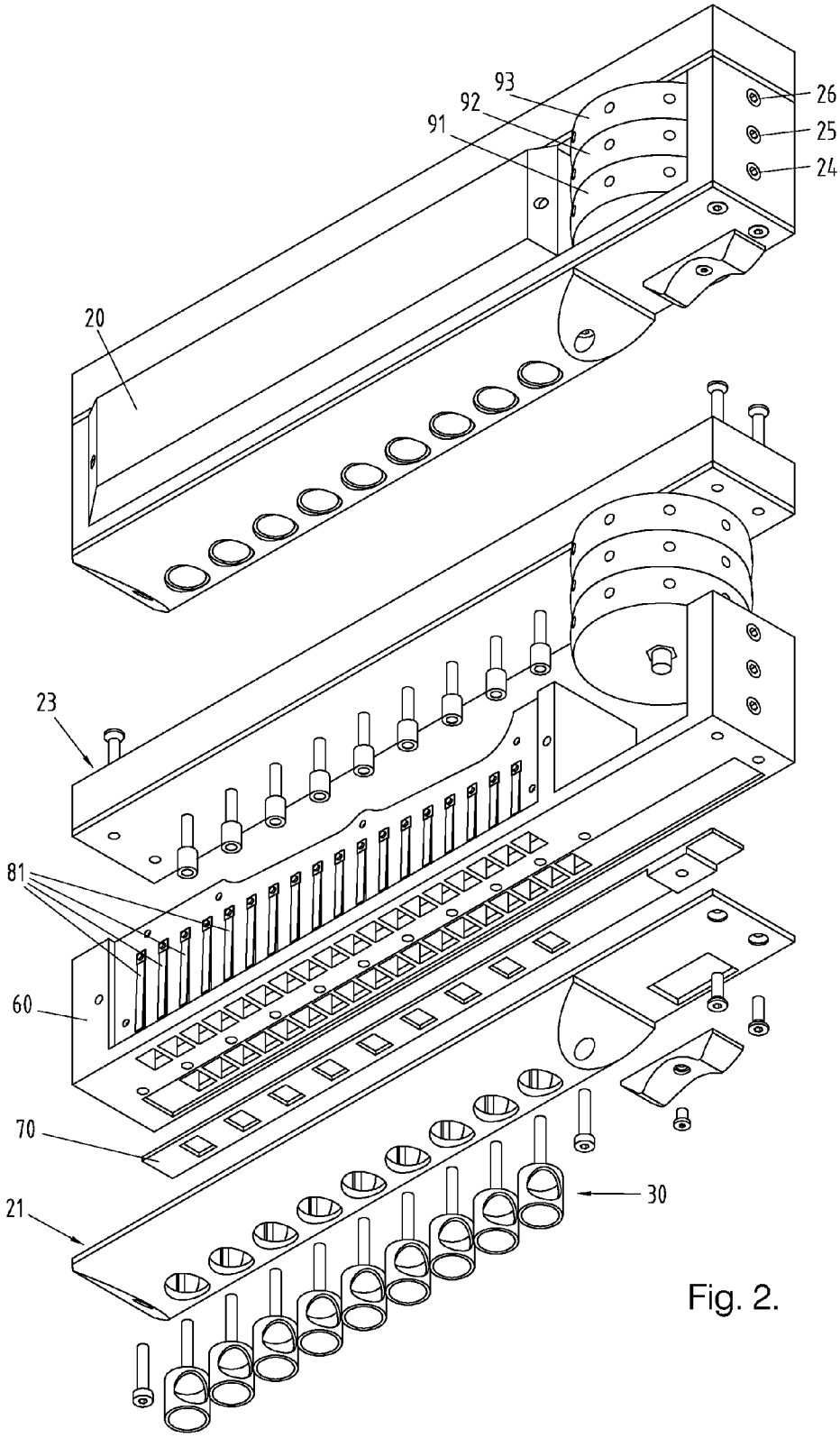
FIG. 1 is an isometric perspective view of a practical embodiment of an adjustable harmonica including cover plates, which, it should be noted, are not included in any other figure or view.
FIG. 2 is an exploded isometric view of the harmonica of FIG. 1 shown separated into its main components.

One embodiment of an adjustable harmonica is illustrated in FIG. 1 which shows an isometric view of a fully assembled harmonica. A top cover plate 20 is shown in this view but in no other views. There is a matching bottom cover plate that is not visible in this perspective nor is it shown in any of the other views. Three detent mechanisms 24, 25, and 26 engage respectively with a first control wheel 91, a second control wheel 92, and a third control wheel 93.

FIG. 2 is an exploded isometric view of major components of the harmonica, namely a body 60, reeds collectively identified as 81, a mouthpiece 21, valves collectively identified as 30, an apertured slide 70, and a control mechanism 23.

Figure 3:
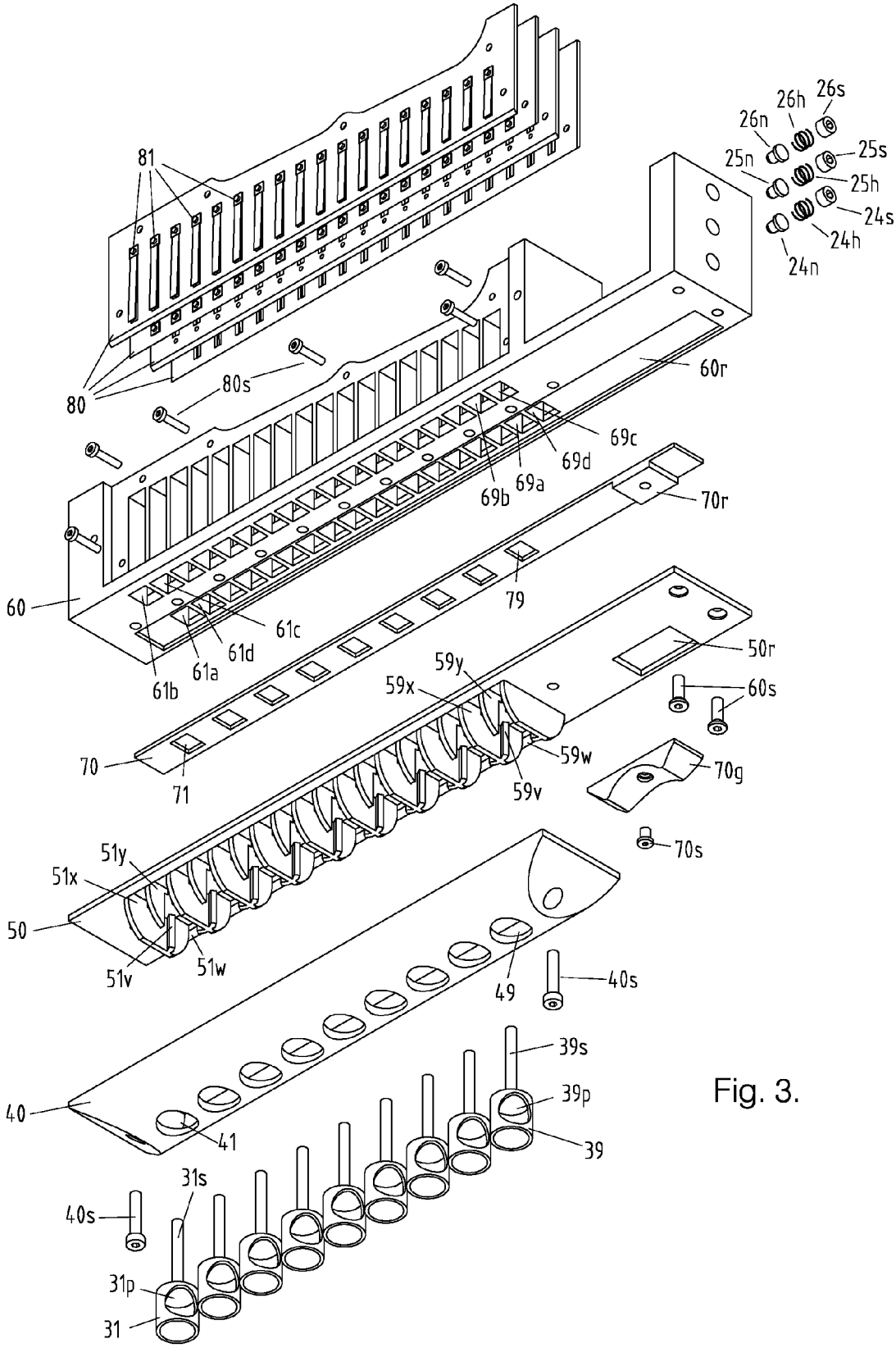
FIG. 3 is a detailed exploded isometric view of the front part of the harmonica of FIG. 1.
Figure 4:
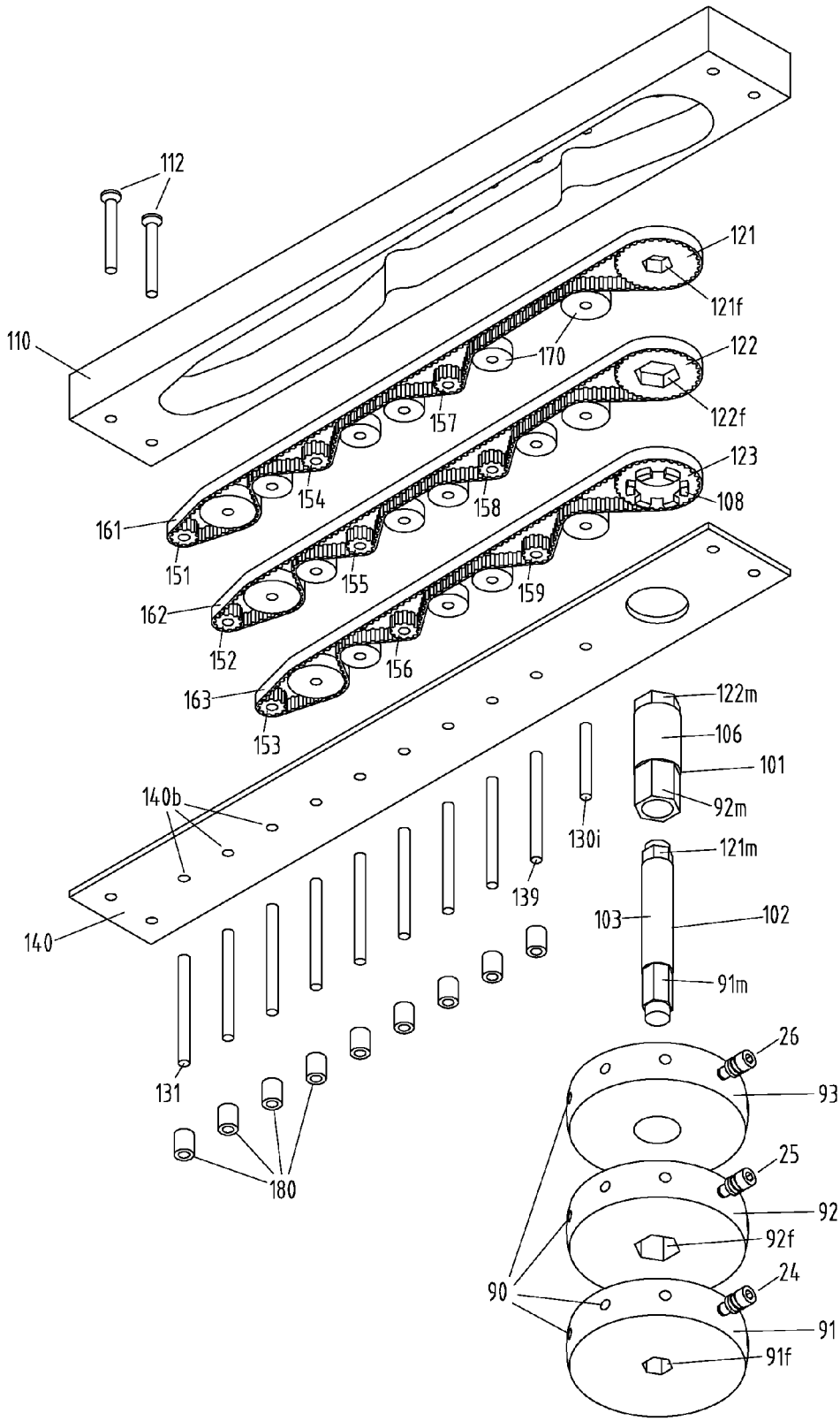
FIG. 4 is a detailed exploded isometric view of the back part of the harmonica of FIG. 1 and combines with FIG. 3 to form a full view of all parts.

FIG. 3 and FIG. 4 together form a full exploded view of the harmonica and should be referred to throughout this discussion in conjunction with any other drawings.

FIG. 3 is an exploded isometric view of the front part of the harmonica. The nine substantially cylindrical cup shaped valves, identified collectively as 30 in FIG. 2, are otherwise identified individually as 31 to 39. The open end of each valve is directed toward the front of the harmonica. Each valve has a port on its side, such ports being designated respectively 31*p* to 39*p*. Integral to each valve is a valve stem directed toward the back of the harmonica, these stems being designated respectively as 31*s* to 39*s*.

Although each valve is described here as cylindrical with a port in its side, in general a cup-shaped valve with a port in its side would be one that is axisymmetric in shape, hollow, with an opening on one end centred about its axis and another opening or port that is not centred about its axis. This is intended to include such shapes as cylinders, tapered cylinders, cones, bullet shapes, partial spheres, bowl shapes, etc., the only constraint being that it function as described here.

A mouthpiece face 40 has a curved shape to facilitate efficient contact with the player's lips, and has a series of nine round mouth-holes formed therein, identified as 41 to 49. The mouthpiece face 40 and a mouthpiece base 50 together form the mouthpiece 21, which is attached to the body 60 with screws collectively identified as 40*s* and 60*s*.

Figure 7:
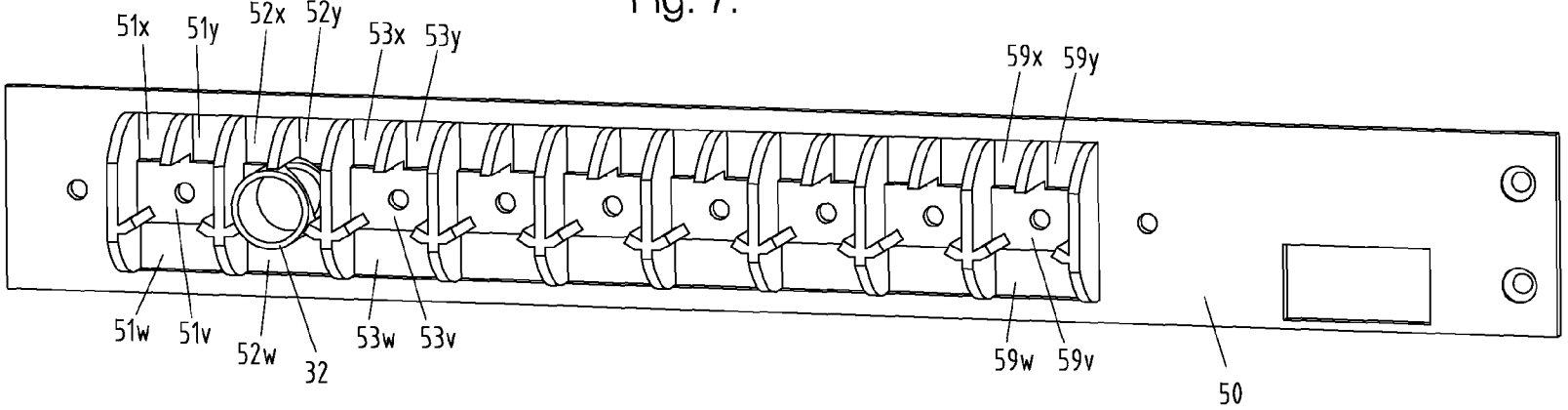
FIG. 7 is a non-isometric perspective view of the base of the mouthpiece and one valve, orientated to show specific details more clearly.

The mouthpiece base 50 has formed within it a series of valve-chambers, identified as 51*v* to 59*v*, into which the valves 31-39 are rotatably mounted. Peripheral to each valve-chamber are three ducts, that connect with said valve-chamber and are open to the back surface of the mouthpiece base. The lower ducts are identified as 51*w* to 59*w*, the upper left ducts are identified as 51*x* to 59*x*, and the upper right ducts are identified as 51*y* to 59*y* respectively. Refer now to FIG. 7 to better determine the shape of the mouthpiece base and the extent of the valve-chambers and the ducts.

In FIG. 7 the valve-chamber 51*v* is shown empty while the neighbouring valve-chamber 52*v* is shown with the valve 32 in place. It can be seen here, by the example of the group of ducts 52*w*, 52*x*, and 52*y*, that the ducts are independent and do not communicate directly with each other.

Figure 10:
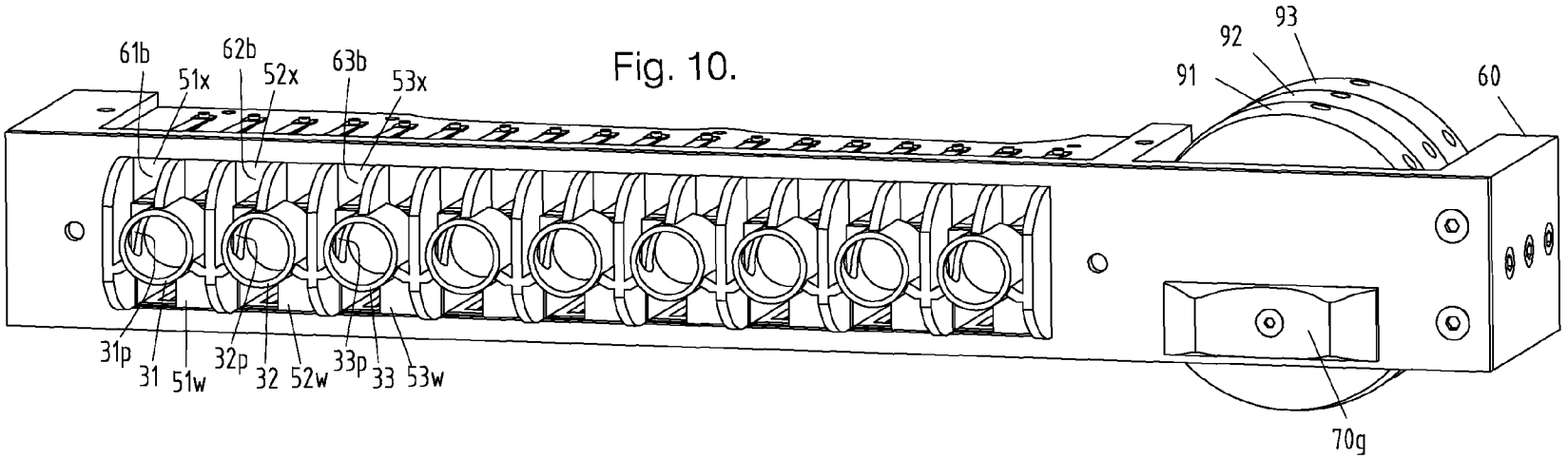
FIG. 10 is a view of the body, control wheels, valves, and slide, with the slide in the leftward position and the valve ports aligned with the upper left ducts.
Figure 11:
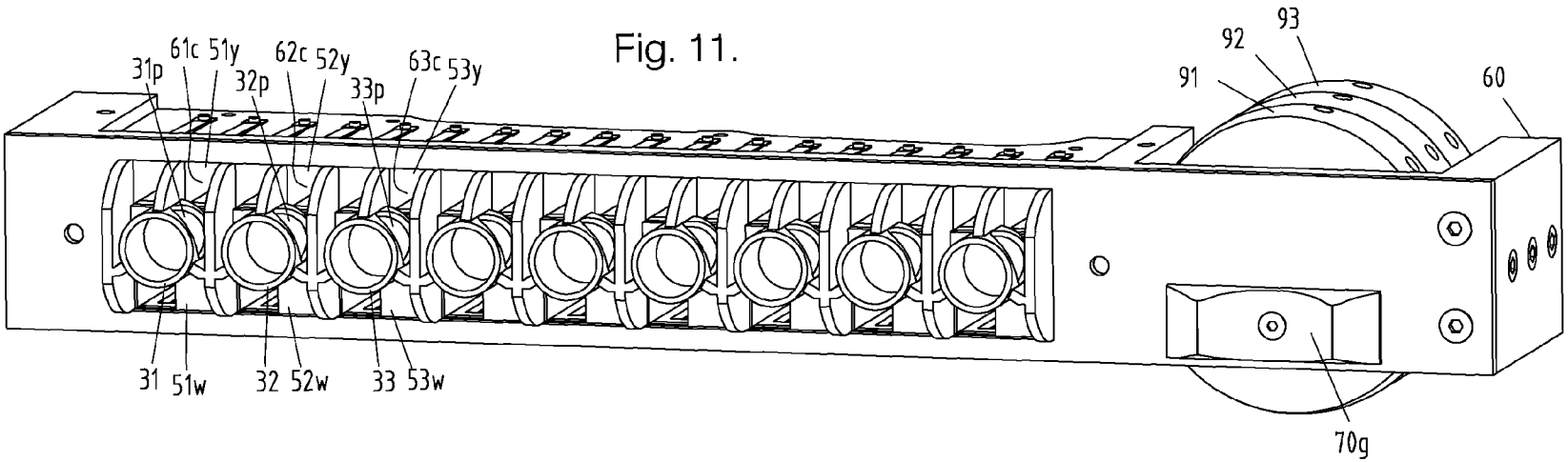
FIG. 11 is a view of the body, control wheels, valves, and slide, with the slide in the leftward position and the valve ports aligned with the upper right ducts.
Figure 12:
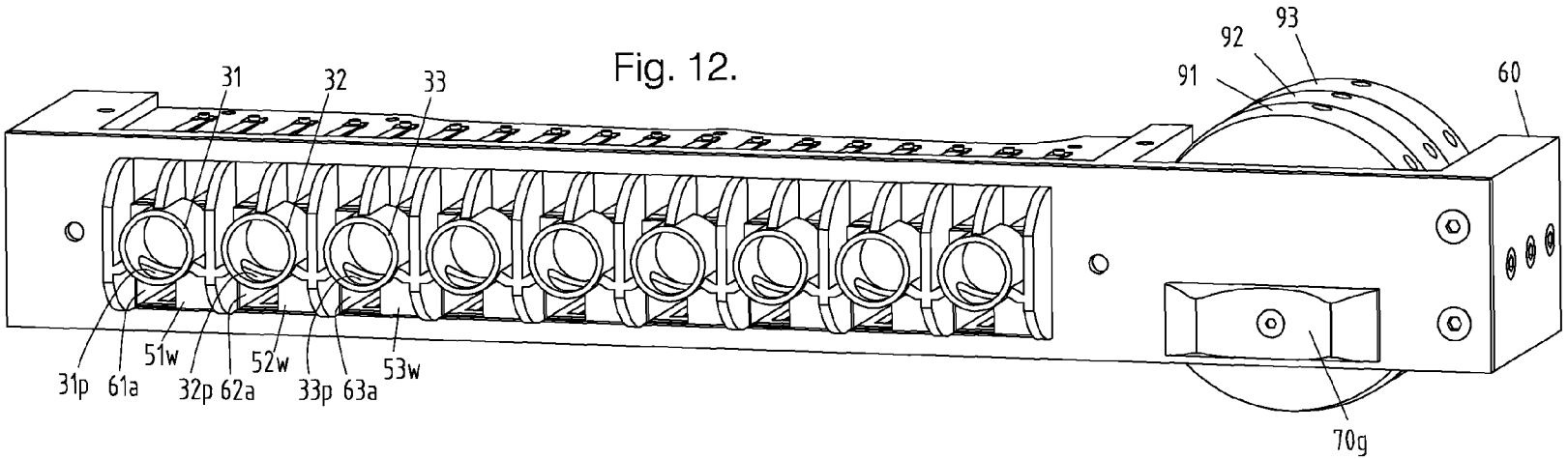
FIG. 12 is a view of the body, control wheels, valves, and slide, with the slide in the leftward position and the valve ports aligned with the lower ducts.
Figure 12A:
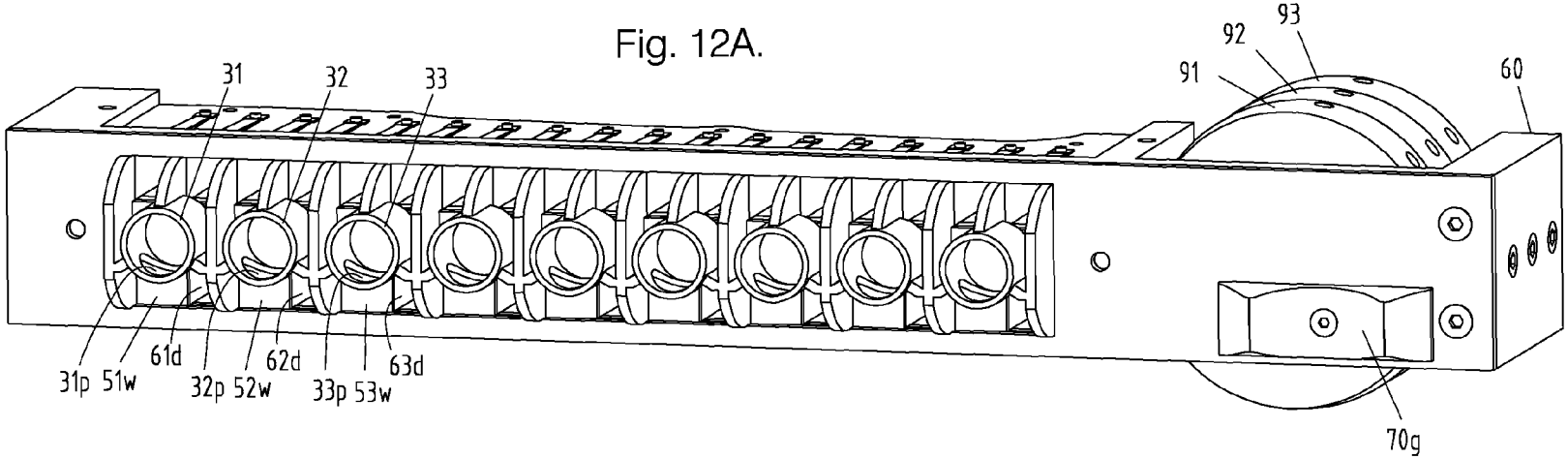
FIG. 12A is a view of the body, control wheels, valves, and slide, with the slide in the rightward position and the valve ports aligned with the lower ducts.

FIG. 10 shows the valves 31-39 positioned such that their ports 31*p*-39*p* are registered with the upper left ducts 51*x*-59*x* respectively allowing communication between the interior of the valves and said ducts. A clockwise rotation of 120 degrees will similarly register the ports 31*p*-39*p* with the upper right ducts 51*y*-59*y* as shown in FIG. 11, and further clockwise rotation of 120 degrees will similarly register the ports 31*p*-39*p* with the lower ducts 51*w*-59*w* as shown in FIG. 12 and FIG. 12A.

Figure 8:
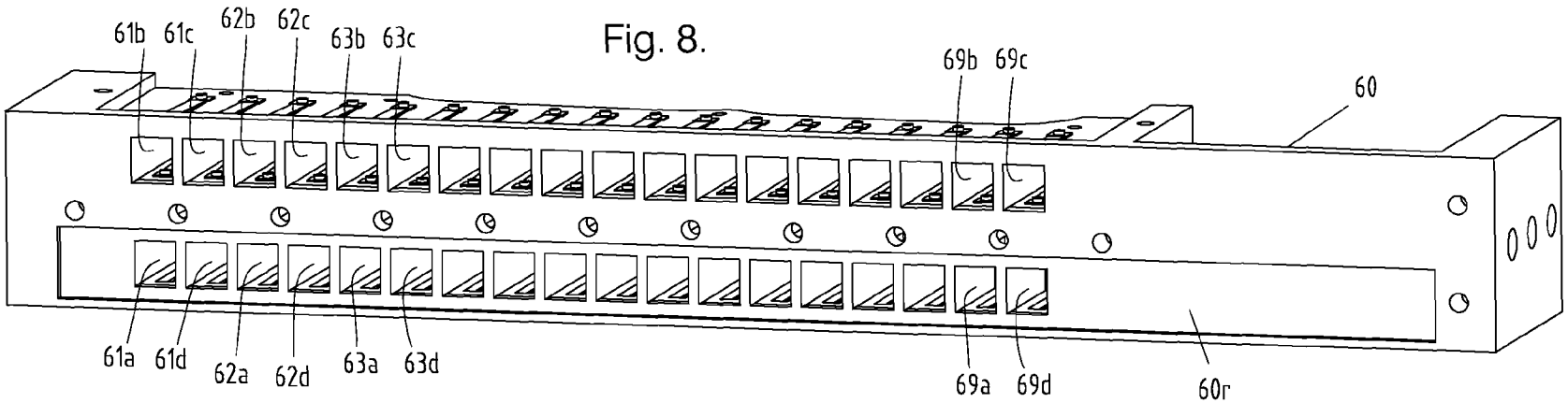
FIG. 8 is a view from the same perspective as FIG. 7 of the body without the slide included.

Referring to FIG. 8 the body has two tiers of 18 cells with each cell opening to the front of the body. The group consisting of the four leftmost cells, two cells from each tier, are designated, starting from the lower left and proceeding in a clockwise direction, as 61*a*, 61*b*, 61*c*, and 61*d*. The group of four cells immediately to the right is designated in a similar clockwise manner as 62*a*, 62*b*, 62*c*, and 62*d*. This pattern of designation is applied along the length of the body with the last group of four being designated as 69*a*, 69*b*, 69*c*, and 69*d*.

Referring to FIGS. 7 and 8, the pair of cell 61*a* and cell 61*d* together align with the lower duct 51*w*, which is substantially twice the width of a single cell opening, and this pattern of alignment continues along the harmonica ending with the pair of cell 69*a* and cell 69*d* together aligning with the lower duct 59*w*. Similarly cells 61*b*-69*b* align with ducts 51*x*-59*x* respectively, and cells 61*c*-69*c* align with ducts 51*y*-59*y* respectively. To better visualize the shape and extend of the ducts refer again to the example of ducts 52*w*, 52*x*, and 52*y* in FIG. 7.

Referring again to FIG. 3, a rabbet 60*r* or wide shallow groove is formed within the front surface of the body, into which the slide 70 is disposed such that it can move laterally between a leftward and a rightward position. The slide 70 has nine holes or apertures identified as 71 to 79, each substantially the same size as a cell opening.

The slide is manipulated by a grip 70*g* which is attached by a screw 70*s* to a raised rectangular section 70*r* of the slide near its right end. There is an opening 50*r* in the mouthpiece base 50 to allow for the lateral motion of the raised section 70*r*.

Figure 9:
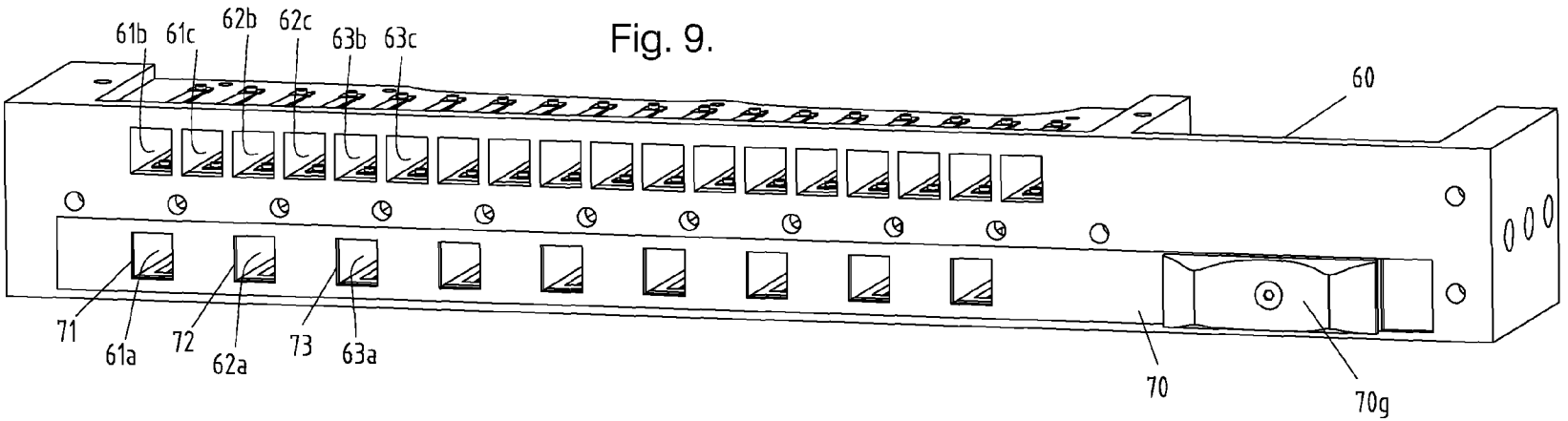
FIG. 9 is a view from the same perspective as FIG. 7 of the body and reed plates with the slide included and shown in its leftward position.
Figure 9A:
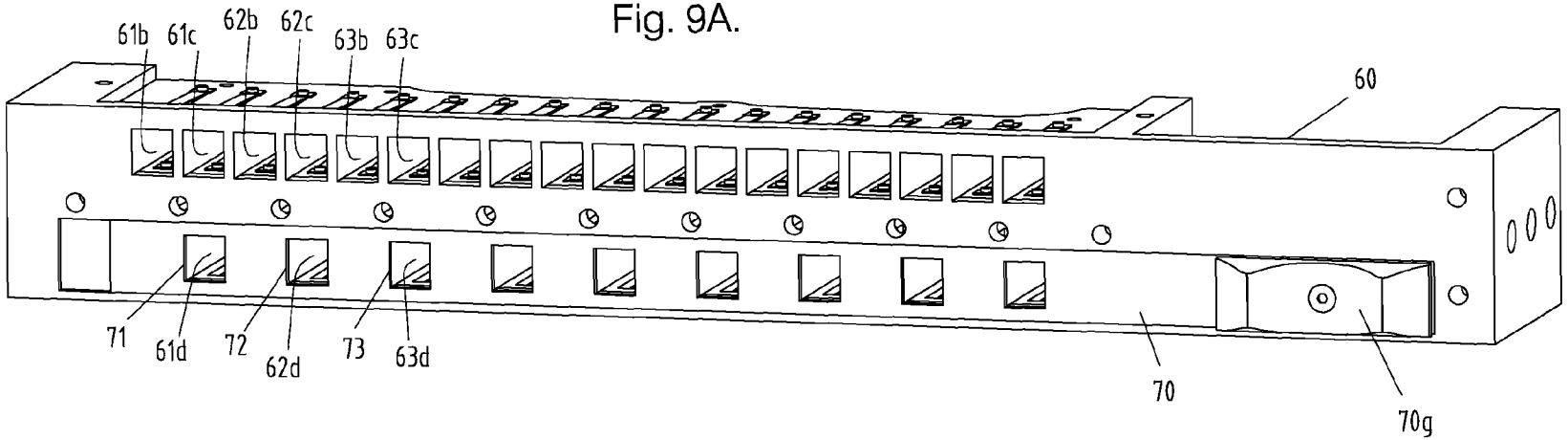
FIG. 9A is similar to FIG. 9 but with the slide shown in its rightward position.

FIGS. 9 and 9A show a pattern of apertures 71-79 and solid sections in the slide 70 such that when the slide is in the leftward position the apertures 71-79 align with lower left cells 61*a*-69*a* and consequently solid sections align with, and thereby block, the lower right cells 61*d*-69*d*. Alternatively, when the slide is in the rightward position the situation is reversed and the lower right cells 61*d*-69*d* are aligned with the apertures 71-79 and the lower left cells 61*a*-69*a* are blocked.

Referring back to FIG. 3, the reeds 81 are attached to four reedplates collectively identified as 80, which are mounted within the body 60 such that there is a blow reed and a draw reed in operative relationship to each cell. The reedplates are held in place by screws collectively identified as 80*s*. The details of this installation can be determined more fully by referring to the view in FIG. 5.

FIG. 3 also shows the three detents 24-26 exploded into their sub-components of nipples 24*n*, 25*n*, and 26*n*, springs 24*h*, 25*h*, and 26*h*, and retaining screws 24*s*, 25*s*, and 26*s*.

Refer now to FIG. 4 which is an exploded isometric view of the back part of the harmonica with the detents included. The detents 24-26 are shown in engaged respectively with the three control wheels 91-93. Each control wheel has a series of nine indentations 90 evenly spaced around its circumference. The indentations cooperate with the detents 24-26 to detain the wheels every 1/9 of a rotation, or 40 degrees.

Figure 5:
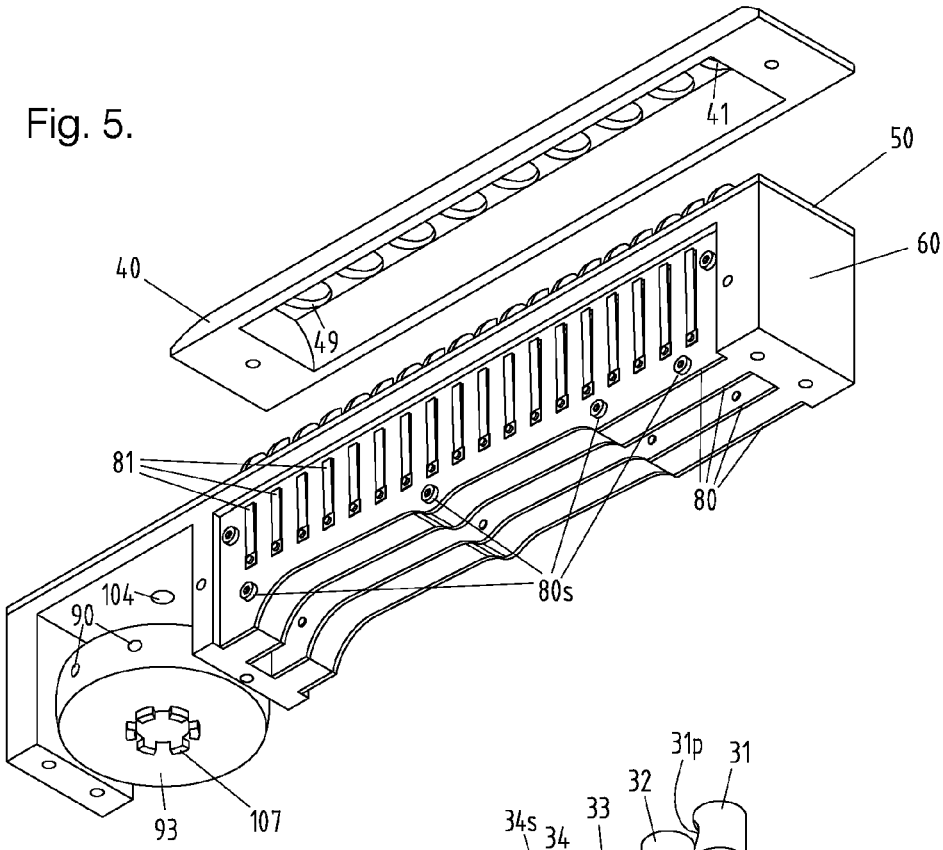
FIG. 5 is an exploded isometric view of the harmonica of FIG. 1 from a viewpoint behind the harmonica, showing only a selection of components.
Figure 6:
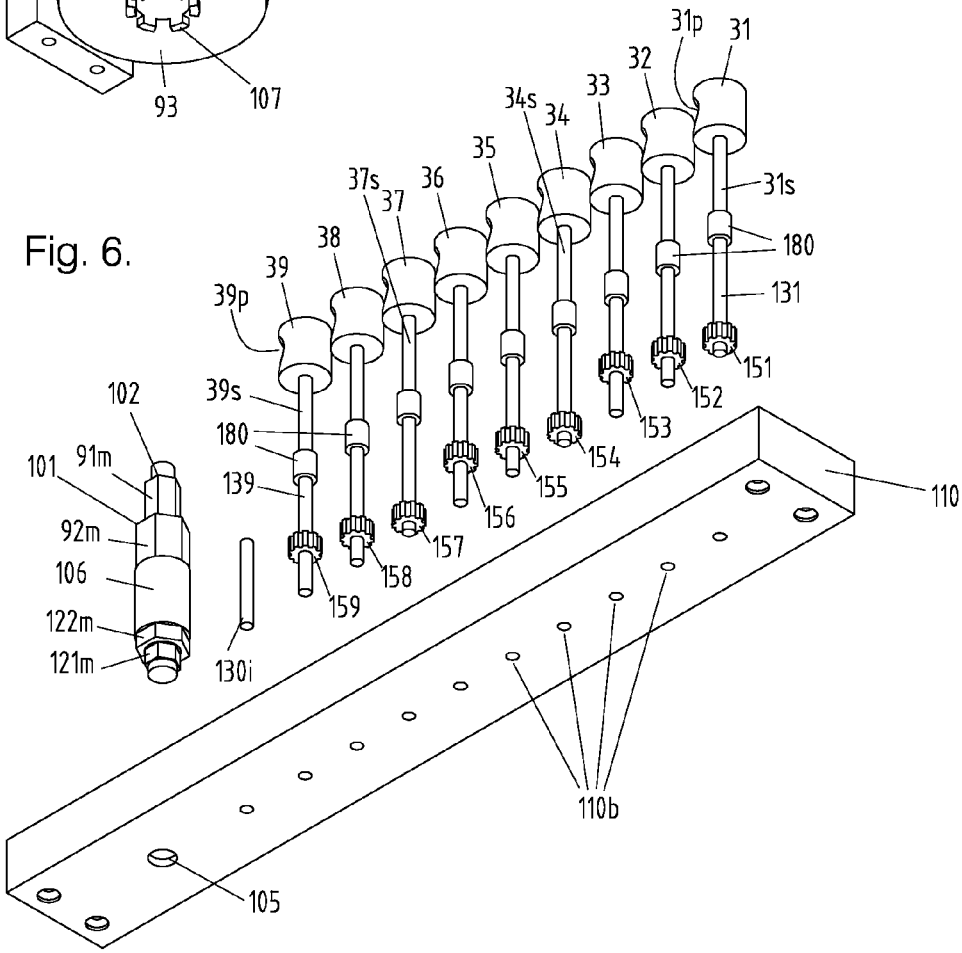
FIG. 6 is an exploded isometric view of the harmonica of FIG. 1 from the same viewpoint as FIG. 5 but showing a different selection of components.

An outer concentric shaft 101 is disposed onto an inner concentric shaft 102 so as to rotate on a bearing surface 103. FIG. 6 shows a supplementary view of these concentric shafts. FIG. 6 also shows a clear view of a cooperating back support bearing 105 which is formed within a control housing 110 and which rotatably supports the back end of the inner concentric shaft 102. FIG. 5 shows a front support bearing 104 formed within the body 60 which rotatably supports the front end of the inner concentric shaft 102.

Referring to FIG. 4, a first driving pulley 121, a second driving pulley 122, and a third driving pulley 123, are mechanically linked to the three control wheels 91-93 respectively, by means of the inner concentric shaft 101 and outer concentric shaft 102.

The first control wheel 91, having a hexagonal central hole 91*f*, is fitted onto a front hexagonal section 91*m* of the inner concentric shaft 102, and the first driving pulley 121, also having a hexagonal central hole 121*f*, is fitted onto a back hexagonal section 121*m* of the inner concentric shaft 102, such that said wheel and said pulley rotate together.

The second control wheel 92, having a central hexagonal hole 92*f*, is fitted onto a front hexagonal section 92*m* of the outer concentric shaft 101, and the second driving pulley 122, also having a hexagonal central hole 122*f*, is fitted onto a back hexagonal section 122*m* of the outer concentric shaft 101, such that said wheel and said pulley rotate together.

The third control wheel 93 and a third driving pulley 123 are rotatably mounted together onto a smooth bearing section 106 of the outer concentric shaft 101. Referring momentarily to FIG. 5 the third control wheel 93 is seen to have a ring of cogs 107 on its back surface. These cogs engage with a matching ring of cogs 108, seen in FIG. 4, on the front surface of the third driving pulley 123, such that said wheel and said pulley rotate together.

Nine pulley shafts identified as 131 to 139 and one idler shaft 130*i* are supported at the front by a series of ten front bearings collectively identified as 140*b* formed within a support plate 140. The perspective of FIG. 6 shows that a series of ten back bearings collectively identified as 110*b* are similarly formed within the control housing 110 and similarly support the pulley shafts and idler shaft at the back. The control housing 110 and the support plate 140 are attached to the body 60 with screws collectively identified as 112.

Nine toothed driven pulleys identified as 151 to 159 are mounted fixedly onto the pulley shafts 131-139 such that pulley and shaft turn together, as shown in FIG. 6. A first toothed belt 161 engages the first driving pulley 121 with the three driven pulleys 151, 154, and 157. A second toothed belt 162 engages the second driving pulley 122 with another three driven pulleys, 152, 155, and 158. A third toothed belt 163 engages the third driving pulley 123 with yet another three driven pulleys 153, 156, and, 159. Note that the number of teeth on each driving pulley is three times the number on each driven pulley so that rotation of the driving pulley through any given angle will result in a rotation of the associated driven pulleys through three times that angle, for example a rotation of driving pulley 121 by 40 degrees or 1/9 of a turn will rotate the driven pulleys 151, 154, and 157 by 120 degrees or 1/3 of a turn.

Nine couplers 180 connect the pulley shafts 131-139 with the valve stems 31*s*-39*s*, a relationship shown clearly in FIG. 6. The couplers 180 are tightly fitted semi-rigid sleeves that create a degree of friction such that the valves 31-39 can be rotationally adjusted with moderate force but will not go out of adjustment in normal use. It is through these couplers that the control mechanism engages the valves, and thereby, selects the duct with which each mouth-hole will communicate.

OPERATION OF THE PRACTICAL EMBODIMENT

The many movable components of this embodiment can be grouped into four independently movable systems. These four movable systems are manipulated with the three control wheels and the slide.

Referring to FIG. 4, the first control wheel 91 is engaged with the detent mechanism 23 so that it rotates 1/9 of a full turn, or 40 degrees, between each resting point. It is connected with the first driving pulley 121 by means of the inner concentric shaft 102. The first driving pulley 121 is subsequently engaged by means of the first belt 161 with the three driven pulleys 151, 154, and 157. The driving pulleys have three times the number of teeth as the driven pulleys so consequently each driven pulley rotates 120 degrees for each 40 degree rotation of its cooperating control wheel.

FIG. 6 shows the three driven pulleys 151, 154, and 157 fixed to their respective shafts, which are engaged with the three valve stems 31*s*, 34*s*, and 37*s* by means of the adjustable couplers 180. FIG. 3 shows the relationship of the valves 31, 34, and 37 to the valve-chambers 51*v*, 54*v*, and 57*v* and mouth-holes 41, 44, and 47. In summary, the first control wheel 91 allows the player to selectively position the valves 31, 34, and 37 within the mouth-holes 41, 44, and 47 respectively, thereby selecting the notes that will sound from those mouth-holes.

The situation is similar for the second control wheel 92, the major difference being that the connection with the second driving pulley 122 is by means of the outer concentric shaft. In summary, the second control wheel 92 allows the player to selectively position the valves 32, 35, and 38 within the mouth-holes 42, 45, and 48 respectively.

The situation is again similar for the third control wheel 93, the major difference being that the connection with the third driving pulley 123 is through engagement of the cogs 107 on control wheel 93 with the cogs 108 on driving pulley 123. In summary, the third control wheel 93 allows the player to selectively position the valves 33, 36, and 39 within the mouth-holes 43, 46, and 49 respectively.

In this discussion, a note that sounds when blowing or drawing breath through a particular mouth-hole or cell is referred to as the 'blow note' or 'draw note' of that mouth-hole or cell, as the case may be. Accidental notes are always considered as sharp notes; and notes are generally referred to simply by their note name, regardless of which octave they are in.

Figure 13:
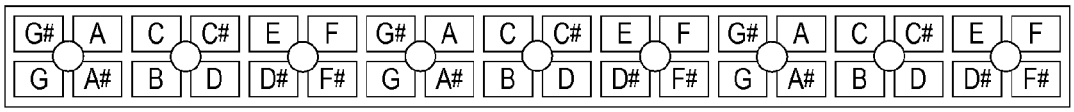
FIG. 13 is a diagrammatic representation of the blow notes of the harmonica.

The blow note for cell 61*a* is G3, or G below middle C, and the blow notes for cells 61*b*, 61*c*, and 61*d* are G#, A, and A# respectively, moving upward in semitones. The pitches of the blow notes for cells 62*a*, 62*b*, 62*c*, and 62*d* continue upward chromatically being, respectively, B, middle C, C#, and D. This meandering pattern continues for all 36 cells thereby encompassing three musical octaves. FIG. 13 is a diagrammatic representation of the cells shown labelled with the blow note of each cell. The pattern of notes repeats every twelve cells or, equivalently, every three mouth-holes.

Figure 13A:
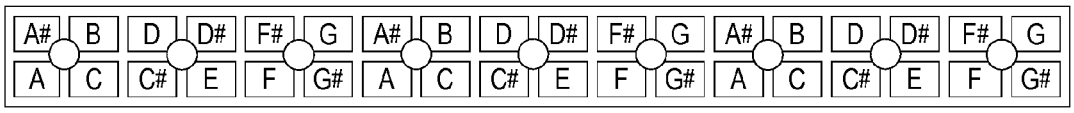
FIG. 13A is a diagrammatic representation of the draw notes of the harmonica.

FIG. 13A is a diagrammatic representation of the same cells shown labelled with the draw notes. The draw note for each cell is a full tone above the corresponding blow note, so wherever the pitches of draw notes are not specifically stated herein they can be deduced.

Figure 14:
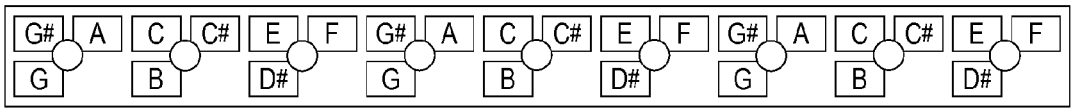
FIG. 14 is a diagrammatic representation of the blow notes of the harmonica which remain unblocked with the slide leftward.
Figure 14A:
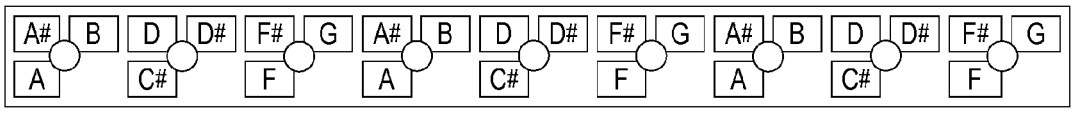
FIG. 14A is a diagrammatic representation of the draw notes of the harmonica which remain unblocked with the slide leftward.

Referring to FIGS. 9 and 9A, the slide grip 70*g* is used to move the slide 70 between the leftward position and the rightward position. The effect of the slide 70 being positioned leftward is to block communication with the cells 61*d*-69*d*. FIG. 14 is a diagrammatic representation of the cells which remain unblocked when the slide 70 is leftward, each cell being labelled with its blow note, and FIG. 14A is a diagrammatic representation of the same situation but with the cells labelled with the draw notes.

Figure 15:
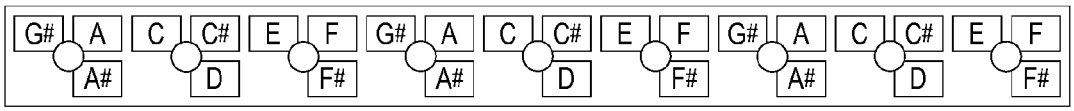
FIG. 15 is a diagrammatic representation of the blow notes of the harmonica which remain unblocked with the slide rightward.
Figure 15A:
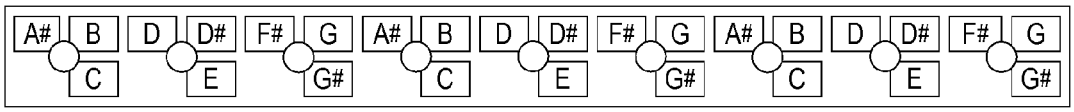
FIG. 15A is a diagrammatic representation of the draw notes of the harmonica which remain unblocked with the slide rightward.

Alternatively, when the slide 70 is positioned rightward the effect is to block communication with the cells 61*a*-69*a*. FIG. 15 is a diagrammatic representation of the cells which remain unblocked when the slide 70 is rightward, each cell being labelled by with blow note, and FIG. 15A is a diagrammatic representation of the same situation but with the cells labelled with the draw notes.

FIG. 10 shows all of the valve ports 31*p*-39*p* registered with the respective upper left ducts 51*x*-59*x*, but because the notes repeat every three mouth-holes the discussion will focus on the first three mouth-holes 41, 42, and 43. In this case the valves 31-33 are registered with the ducts 51*x*-53*x*, which are aligned and communicating with cells 61*b*-63*b*. Referring to FIG. 13, cells 61*b*-63*b* have the blow notes G#, C, and E respectively. Here the slide 70 is shown in its leftward position but special note should be taken that the position of the slide 70 has no effect on the notes produced when the ports are registered with the upper left ducts.

FIG. 11 shows the valves 31-33 are registered with the ducts 51*y*-53*y*, which are aligned and communicating with cells 61*c*-63*c* which, referring to FIG. 13, have the blow notes A, C#, and F respectively. Again, note that, although the slide 70 is shown in its leftward position, the position of the slide 70 has no effect on the notes produced when the ports are registered with the upper right ducts.

FIG. 12 shows the valves 31-33 are registered with the ducts 51*w*-53*w*, which, each being substantially twice the width of a cell, are aligned respectively with the pairs of cells, 61*a* & 61*d*, 62*a* & 62*d*, and 63*a* & 63*d*. However, with the slide 70 leftward as shown, communication is possible only with cells 61*a*-63*a*, which, referring to FIG. 13, have the blow notes G, B, and D# respectively. In this case, in contradistinction to the situation illustrated in FIG. 10 and FIG. 11, the position of the slide 70 does have an effect on the notes produced. This can be seen in FIG. 12A which is the same as FIG. 12 but with the slide 70 rightward. Here it is the cells 61*d*-63*d* with which communication is possible. The blow notes of cells 61*d*-63*d* are A#, D, and F# respectively.

Because each of the valves 31-33 can be rotated independently by control wheels 91-93 respectively, the information regarding notes presented above can be restated as follows. With the slide 70 leftward mouth-hole 41 can independently produce any of the blow notes G, G#, or A, mouth-hole 42 can independently produce any of the blow notes B, C, or C#, and mouth-hole 43 can independently produce any of the blow notes D#, E, or F. These are the notes shown in FIG. 14. With the slide 70 rightward the blow notes become G#, A, or A# for mouth-hole 41, C, C#, or D for mouth-hole 42, and E, F, or F# for mouth-hole 43. These are the notes shown in FIG. 15. The respective draw notes are shown in FIG. 14A and FIG. 15A.

With a choice of three notes for each of the three mouth-holes 41-43 there are 27 possible combinations of notes. The 27 possible combinations of blow notes in mouth-holes 41-43, with the slide 70 leftward, are tabulated along with chord names in FIG. 16, and the corresponding combinations of draw notes, always a tone higher, are tabulated in FIG. 17. The 27 possible combinations of blow notes in the mouth-holes 41-43, with the slide 70 rightward, are tabulated along with chord names in FIG. 18, and the corresponding combinations of draw notes are tabulated in FIG. 19. Note that in this context a chord consisting of tonic, major third, and flat seventh, but no fifth, is referred to as a seventh chord. For example C7 means the notes C, E, and Bb, or using the notational standard adopted for this discussion, C, E, and A#.

FIG. 13 shows that every note in the range of the harmonica is available as a blow note, and FIG. 13A shows that every note in the range of the harmonica is also available as a draw note. Consequently, not only can chromatic melodies be played in all keys, but they can be so played using all blow notes, or all draw notes. This capability allows musical phrases to be optionally played without reversal of the breath.

FIGS. 16, 17, 18, and 19 together show seven different chord types in all 12 keys, many of which are available in two or more places.

CONCLUSION, RAMIFICATIONS, AND SCOPE

Thus the reader will see that according to the one practical embodiment of the invention described in detail, I have provided an adjustable harmonica that can play chromatic melodies and chords in every key with equal ease, that is easy to operate, that is straightforward to manufacture, and that is similar in form to existing harmonicas, thereby being playable using existing skills and techniques.

While the above description contains many specificities, these should not be construed as limitations on the scope of any embodiment, but as exemplifications of one embodiment. Many other ramifications and variations are possible.

For example an embodiment with four control wheels controlling four groups of mouth-holes rather than three has a much greater number of states than the embodiment presented herein, and allows playing of the four-note harmonies typical of jazz. Another example is an embodiment with six control wheels designed specifically to mimic the harmonic capabilities of a guitar. Similarly, embodiments that mimic the harmonic capabilities of other instruments are possible. Other embodiments which are simpler in design have fewer states, and subsequently less versatility, but provide instruments suited to special purposes.

Accordingly, the scope should be determined not by the embodiment illustrated but by the appended claims and the their legal equivalents.

The invention claimed is:

1. An adjustable harmonica comprising:

a. a body having a plurality of cells formed therein, each cell extending to the front of said body;

b. a plurality of tuned vibratable reeds disposed within said body, each reed being situated in an operative relationship to one of said cells in said body;

c. a mouthpiece adjoined to the front of said body;

d. said mouthpiece having a plurality of valve-chambers formed therein, each valve-chamber extending to the front of said mouthpiece, and e. said mouthpiece additionally having a cooperating plurality of groups of ducts formed therein, such that for each valve-chamber and cooperating group of ducts, each duct in said group connects said valve-chamber to one or more of said cells in said body; and f. a cooperating plurality of cup-shaped valves, one valve for each of said valve-chambers, each valve having a port formed through its side;

g. where each valve is rotatably mounted within said cooperating valve-chamber such that the open end of said valve is directed toward the front of said mouthpiece and such that said port of said valve is selectively registrable with each duct in said cooperating group of ducts, by rotation of said valve, whereby a continuous air passage is selectively formed from the front of said valve-chamber, through said mouthpiece to one or more thereby selected cells.

2. An adjustable harmonica as defined in claim 1, further comprising one or more movable apertured slides interposed between said mouthpiece and said body.

3. An adjustable harmonica as defined in claim 1, further comprising means for rotating said valves.

4. An adjustable harmonica as defined in claim 1, further comprising a system of cooperating components for rotating said valves.

5. An adjustable harmonica as defined in claim 1, further comprising a system of cooperating mechanical components for rotating said valves.

6. An adjustable harmonica as defined in claim 1, further comprising a system of cogged pulleys and cogged belts for rotating said valves.

* * * * *